United States Patent [19]

Christian

[11] Patent Number: 4,530,444

[45] Date of Patent: Jul. 23, 1985

[54] SEPARATION DEVICE FOR SINGLE COPY NEWSPAPER VENDOR

[76] Inventor: Donald K. Christian, P.O. Box 5806, Spartanburg, S.C. 29304

[21] Appl. No.: 430,472

[22] Filed: Sep. 30, 1982

Related U.S. Application Data

[63] Continuation-in-part of Ser. No. 286,336, Jul. 23, 1981, Pat. No. 4,418,836.

[51] Int. Cl.[3] ..... G07F 11/14

[52] U.S. Cl. ..... 221/37; 414/118; 271/128; 271/18; 221/229; 221/232; 221/241

[58] Field of Search ..... 221/37, 210, 225, 226, 221/228, 229, 232, 236, 241, 255–257, 261, 311; 414/117–118, 110; 271/42, 128, 18, 21–23

[56] References Cited

U.S. PATENT DOCUMENTS

| | | | |
|---|---|---|---|
| 2,576,636 | 11/1951 | Opgenorth | 271/42 |
| 2,858,047 | 10/1958 | Williams et al. . | |
| 3,114,475 | 12/1963 | Etes . | |
| 3,263,859 | 8/1966 | Searle . | |
| 3,768,695 | 10/1973 | Pearson . | |
| 4,000,831 | 1/1977 | House | 221/229 |
| 4,043,484 | 8/1977 | Vanjo | 221/213 |
| 4,140,243 | 2/1979 | Etes . | |
| 4,174,047 | 11/1979 | Owens | 221/227 |
| 4,216,877 | 8/1980 | Dutro | 221/213 |
| 4,319,695 | 3/1980 | Dutro | 221/213 |
| 4,418,836 | 12/1983 | Christian | 221/229 |

*Primary Examiner*—H. Grant Skaggs

[57] ABSTRACT

A single copy vending machine for newspapers, magazines or the like which employs a separation device attached to the door of a conventional appearing newspaper vendor to separate the topmost newspaper from a stack thereof subsequent to the insertion of proper coinage and the opening of the door. A sequentially selective elevator mechanism is provided to insure that the topmost newspaper of a stack on the elevator is in the path of the fully retracted separation device. A novel newspaper display chamber is provided to first, facilitate the proper adjustment of the separation device and, secondly to hold remote, from purchaser access, content of the display chamber until the elevator supply has been exhausted.

4 Claims, 14 Drawing Figures

SEPARATION DEVICE FOR SINGLE COPY NEWSPAPER VENDOR

A continuation in part of U.S. patent application Ser. No. 06/286,336 filed July 23, 1981, now U.S. Pat. No. 4,418,836.

BACKGROUND OF THE INVENTION

Over the past many years the need for a newspaper vendor that would dispense one newspaper at a time has been recognized. As far back as 1891 U.S. Pat. No. 464,067 was issued to M. H. Foster for a drop shelf vendor. Other examples of the drop shelf vending of periodicals are U.S. Pat. Nos. 1,256,071 Steiner; 2,753,003 Fancher; 2,904,216 Poland; 3,946,846 Pepiciello and many others. Each, no doubt, an improvement over the other but all relatively slow to load and expensive to produce. Even the present inventor's application Ser. No. 066,481 which teaches a shelf orientation conducive to loading a multiplicity of papers at one stroke is still substantially more expensive to manufacture and not as fast to load as the conventional semi-honor bulk load vendors. More recently efforts have been expended to develop bulk load single copy vendors as evidenced by U.S. Pat. Nos. 2,858,047 Williams et al.; 3,114,475 Etes; 3,263,859 Searle; 3,768,695 Pearson; 4,043,484 Vanjo; 4,140,243 Etes; 4,174,047 Owens and others. The bulk loading machines, while generally less expensive to manufacture and quicker to load, have been somewhat unacceptable for one or more of the following reasons: They tend to jam thus irritate potential purchasers. They are awkward to adjust. They are slow to adjust and load. They dispense more than one product. They fail to deliver the product.

The present inventor's co-pending U.S. patent application Ser. No. 218,475, which has been abandoned, tends to minimize the foregoing points but it too is relatively expensive and even more importantly, does not have the same general appearance that the public has come to expect of newspaper vendors. Unfamiliar appearance has been judged at least partially responsible for sales drop in several U.S. cities.

SUMMARY OF THE INVENTION

It is the object of the present invention to materially improve the dependability and customer acceptance of single copy bulk load periodical vending. Another object of the present invention is to provide an improved separation device for removing one product from a stack of products. Another object of the present invention is to provide a simple adjusting means for compensating for the frequent change in product thickness typical of the publishing industry. It is another object of the present invention to present to the public a periodical vendor of familiar design and function that will reasonably insure full payment for each of the papers removed therefrom.

Generally speaking, the apparatus of the present inventon comprises a cabinet, said cabinet containing an access door to a product storage area and a customer access door pivotally mounted therein, through which a single periodical may be removed from each opening thereof, a separation device for removing a single newspaper from a stack of newspapers, an elevator assembly so oriented as to position the topmost periodical of a stack thereof in a predetermined position and an area for containing a display newspaper remote from the customer access area as long as periodicals are available from the principal supply area.

More specifically, the embodiment of the present invention comprises a cabinet which serves as a framework to contain a storage area for a stack of periodicals to be vended. Affixed to said cabinet is a housing to contain an appropriate vending mechanism to hold closed or, upon insertion of proper coinage, release the customer access door of said cabinet in a manner will known to those skilled in the art or as is taught in the present inventor's copending U.S. Pat. No. 4,382,499. Contained within said cabinet and affixed to said door is a separation device so oriented as to remove the topmost periodical from the stack thereof as said door is opened. Also contained within above mentioned cabinet is a spring biased elevator to sequentially elevate the stack of periodicals so that the topmost periodical is generally in the path of said separation device when said customer access door has been closed. A guiding device to which the aforementioned separation device is pivotally attached is provided to rest on the topmost periodical. A gauging means is provided whereby an appropriate relationship between said guiding device and said separation device can be readily established. A periodical display area is provided which is composed of a chamber contained generally within the customer access door. The same is functionally transparent on the outside and is so constructed as to contain a display copy of a periodical being held inaccessible to the public until the principal supply of newspapers has been exhausted. Appropriate linkages are provided to make the content of said chamber available in due sequence. Imprinted in such manner as to be visible to the public subsequently, but concealed by said display periodical may be the legend "SOLD OUT". The aforementioned spring biased elevator is provided with a brake to obstruct its upward motion beyond a predetermined leval and to obstruct its upward motion irrespective of the level when said customer access door is not fully closed. Also provided is a means for relaxing the force of the elevator springs during the loading process. Also provided are such restraining devices as are required to insure the level ascent of said elevator. An appropriate lock and hinge are provided so that the front of the cabinet may be swung away thus providing easy access for rapid loading of the product storage area. Said means for relaxing the force of said elevator springs is attached thereto.

DESCRIPTION OF THE PREFERRED EMBODIMENTS

Making reference to the Figures, a specific embodiment of the present invention will now be described in detail.

Figure 1:
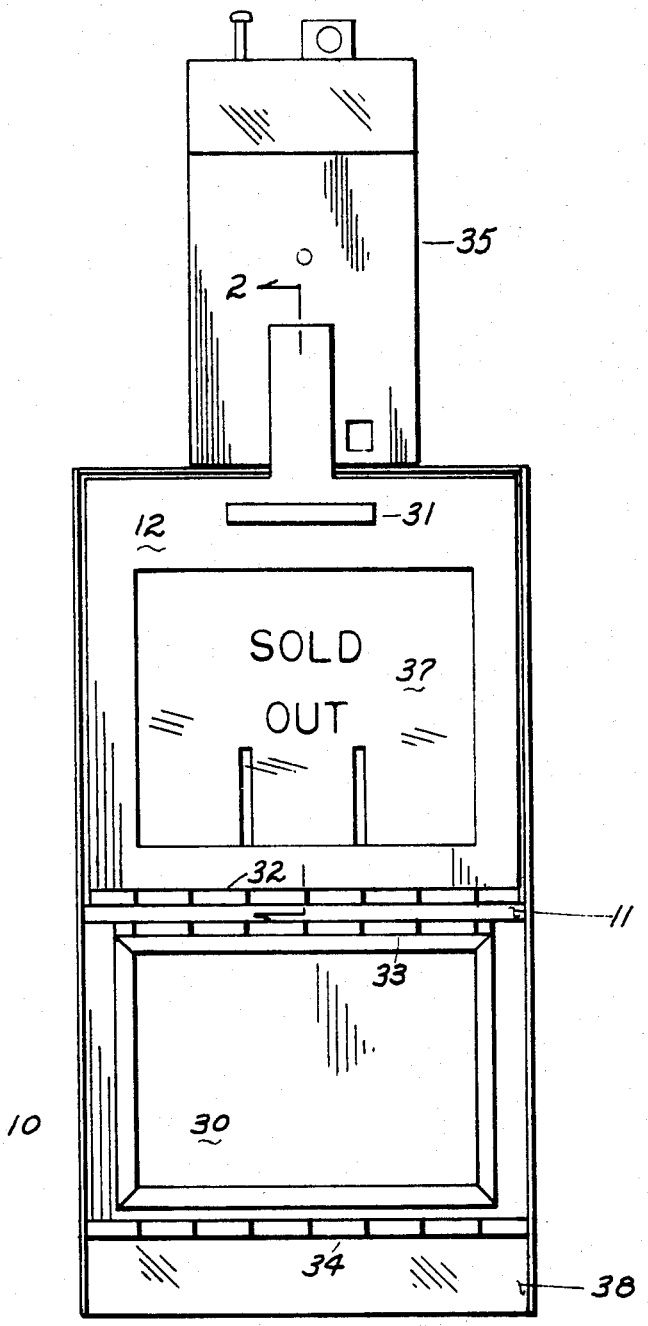
FIG. 1 is the front view of the vending machine.

FIG. 1 illustrates a newspaper vending machine. Basically, instant machine is comprised of cabinet generally indicated as 10, purchaser access door 12, card holder 30, coin mechanism enclosure 35, and display area 37. Said purchaser access door, being spring biased in a closed position is pivotally mounted by spring hinge 32 and provided with handle 31. Said card holder is pivotally suspended from hinge 33.

Figure 7:
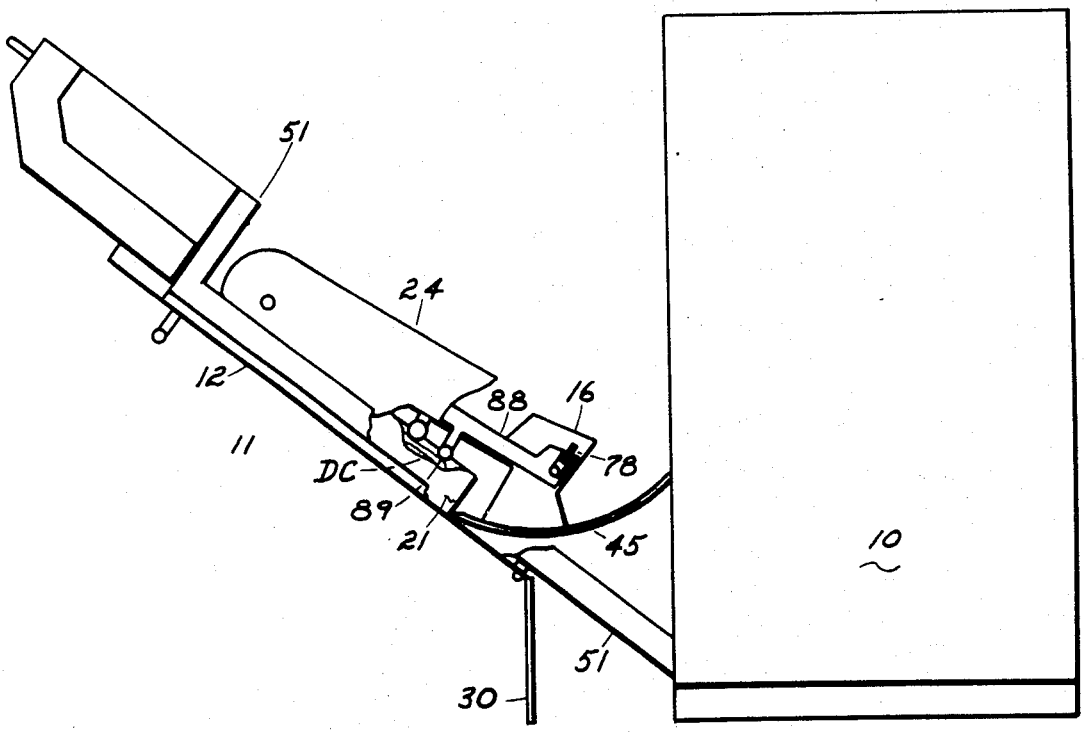
FIG. 7 is a side view of the vendor with access door to product storage area open with separation device and guiding assembly engaged with display area chamber. (Drawer slide has been removed for pictorial convenience.)

Product storage access door 11, to which hinges 32 and 33 are affixed is in turn pivotally mounted to cabinet base 38 by means of hinge 34. Said door 11, to which enclosure 35 is affixed, in conjunction with base 38, comprises the front of the machine. FIG. 7 best illustrates this door assembly.

Figure 2:
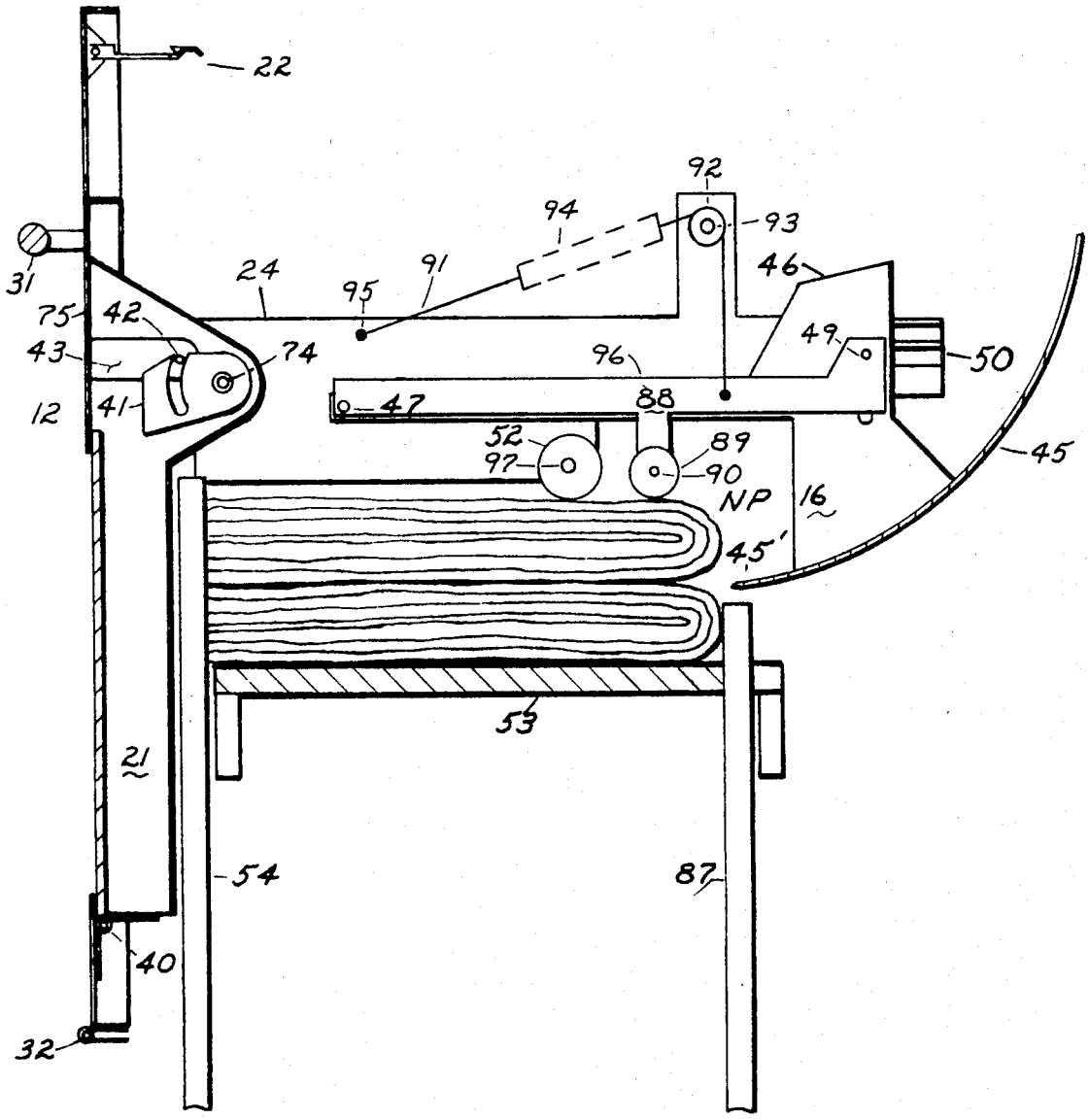
FIG. 2 is a right hand cross-sectional view of the product storage area taken along line 2 of FIG. 1 showing the elevator, the separation device, and the customer access door including the display chamber.

In reference to FIG. 2 a dispensing mechanism is shown which includes a guide assembly 24, a separation assembly 16 and a slide support assembly 88. The guide assembly 24 is pivotally secured to display chamber 21 which, in turn, is normally engaged with purchaser access door 12 by means of hinge 40 and catch 41. Door 12 is provided with pin 42 and support 43, each in turn rigidly affixed to said door.

Separation assembly 16, comprised of slide 45, side members 46 and slide support assembly 88 is pivotally secured to guide assembly 24 by pins 47. Slide 45 is rigidly affixed to side members 46. Slide support assembly 88 is comprised of rollers 89, shaft 90, cable 91, sheave 92, shaft 93, rollers and sheave retainers not shown, spring 94 and anchor 95. Anchor 95 is rigidly affixed to guide 24. By means of spring 94 acting on slide support 96 and anchor 95 through cable 91 in cooperation with sheave 92, slide assembly is biased in an upward manner. When locking device 78, represented in this view by rod 49, is closed locking said slide support assembly to side members 46, the total weight thereof tends to overpower the heretofore mentioned spring bias, resulting in a nearly weightless separation assembly. Record of this aspect of the invention is established in U.S. Patent Office Disclosure Document No. 105,844 filed Jan. 26, 1982 by the inventor.

Drawer guides 50, pivotally secured to product access door frame 51, are operatively associated with said separation assembly and guide assembly 24. With rollers 52 resting on topmost newspaper, guide assembly roller 89, also resting on topmost newspaper, will position point 45' of slide generally on a plane established by the bottom of topmost newspaper NP and the newspaper adjacent thereto; said newspapers being supported by spring biased elevator platform in a manner more fully described later in the specifications.

Upon insertion of proper coinage, latch 22 will, in a manner familiar to those skilled in the art, be released. As purchaser exerts outward force on handle 31, door 12 will pivot about hinge 32, guide assembly 24 and separation assembly 16 will move outward causing point 45' to be inserted between the topmost newspaper and the newspaper adjacent thereto. Hopper members 54 and 87 are provided to restrain said newspapers. Hopper member 54 is in the form of a vertical extending surface that restrains or prevents copies from sliding to a position of customer access. Surface of slide 45 is provided with a low friction finish so that topmost newspaper NP will readily move on the contoured surface thereof. In reference to FIGS. 6 and 13 separation assembly is provided with cam rollers 98 on each side. Ramps 99 are rigidly affixed to inside of cabinet in such manner that as purchaser door 21 is opened, cam rollers 98 will ascend ramps 99 lifting point 45' of slide 45 above hopper member 54, thus freeing newspaper NP from all restraint leaving it free to slip from slide to an area readily accessible to purchaser. When purchaser has removed newspaper and released spring biased door 12, separation assembly 16 is returned to its position of rest as shown in FIG. 2. Upon approaching its position of rest, elevator platform 53 raises the new topmost paper to vend position in a manner that will now be described.

Figure 3:
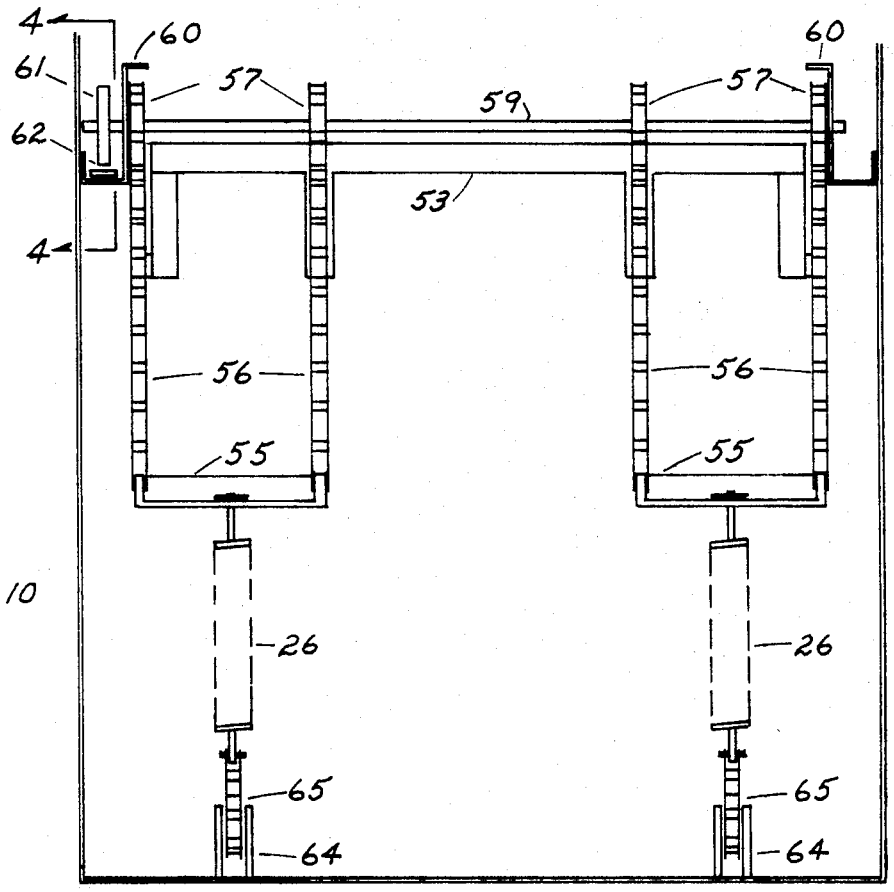
FIG. 3 is a rear view of the elevator.
Figure 4:
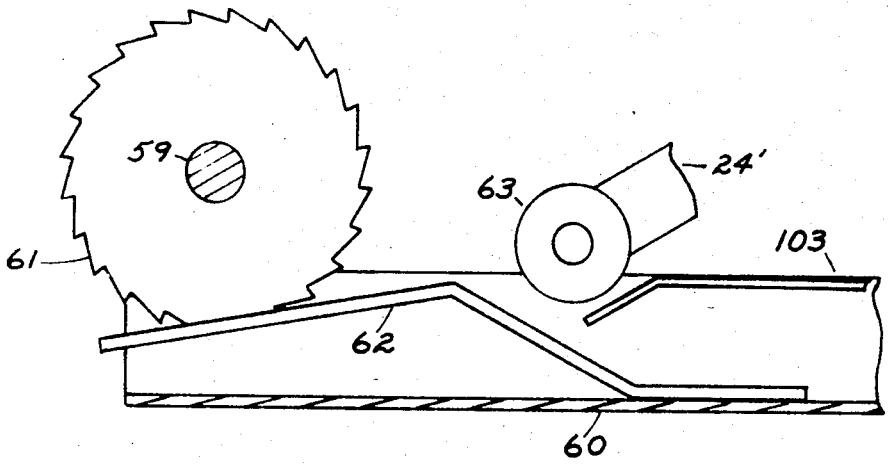
FIG. 4 is a sectional view of the elevator brake taken along lines 4—4 of FIG. 3.
Figure 5:
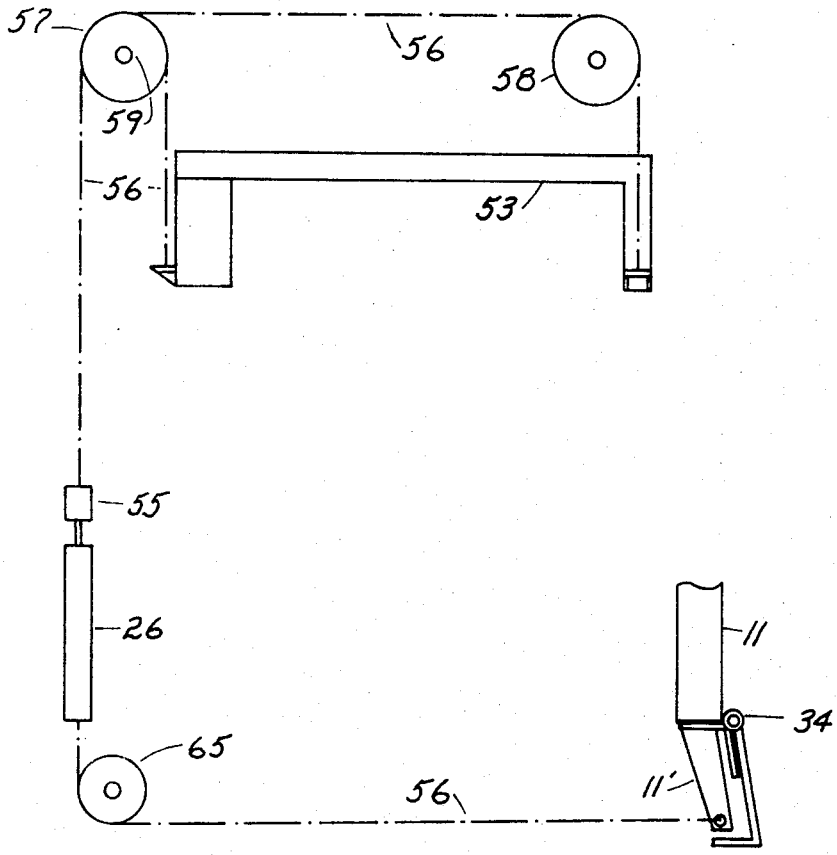
FIG. 5 is a side semi-schematic view showing the suspension of the elevator.

In reference to FIGS. 3, 4, and 5; with product area access door 11 closed, elevator springs 26 exert sufficient force through cross member 55 and roller chains 56 in conjunction with idlers 65 and anchor 11' to insure that empty platform 53 will rise above level of the slide point 45' or when newspapers are placed thereon that the topmost one will be in a position of contact with rollers 52. When access door 11 is rotated outward about hinge 34, anchor 11', being an integral part of door 11, relaxes the force of springs 26 thus facilitating the loading of said platform. Sprockets 57 are affixed to timing shaft 59 in such manner that, in cooperation with idler sprockets 58, elevator platform will remain substantially level at all elevations. Shaft 59 is rotatable mounted in support member 60 in such manner that brake ratchet 61, being rigidly affixed to said shaft, is held in proper relationship to brake spring 62 as shown in FIG. 4; in turn, support members 60 are rigidly affixed to cabinet 10 as are idler brackets 64.

Figure 9:
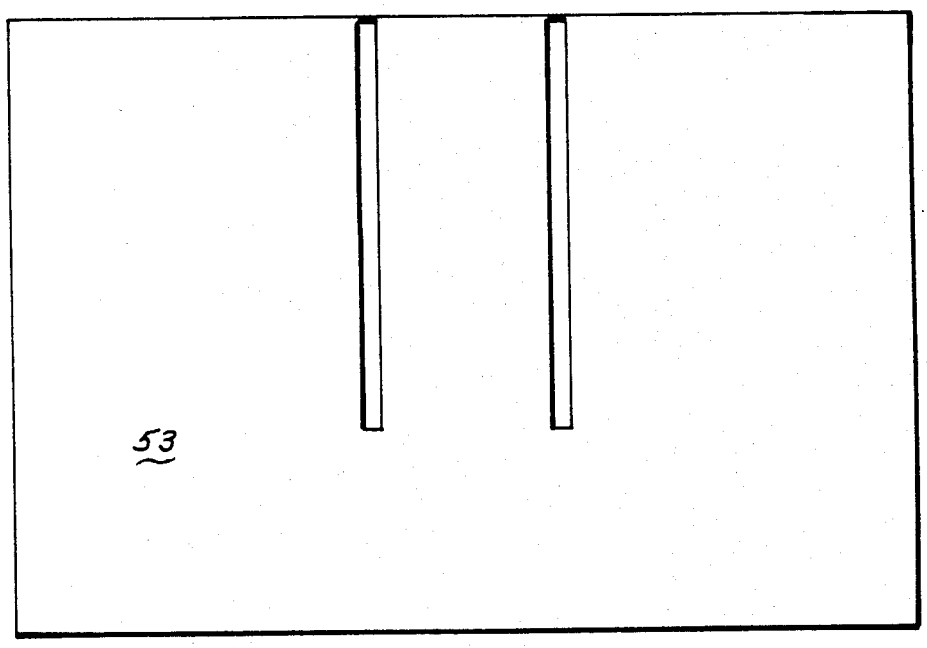
FIG. 9 is top of elevator platform showing relief for rollers.

In reference to FIGS. 4 and 9 and again in reference to FIGS. 3 and 5: as shown, elevator platform 53 is held immobile when roller 63, rotatably contained on arm 24', an integral part of shield 24, is not in contact with spring 62. Roller 63 is so oriented as to depress said spring removing it from a position of restraint to the counter clock-wise rotation of timing shaft 59 when purchaser access door 12 is nearly closed and separation assembly 16 is positioned in such manner that the next newspaper is free to rise above point 45'. When no newspapers remain on elevator platform 53, rollers 52 will enter openings provided therefore in the surface of said platform permittng point 45' to assume a position below the framework of platform 53. There will not be an interference between slide 45 and roller chains 56 as might be supposed as slide 45 is tapered away from point 45' in a spade-like manner thus eliminating that portion thereof which might interfere. It should also be noted that said taper configuration facilitates the entry of said slide between two newspapers.

As will now be described, in reference to FIGS. 2 and 6; display newspaper, now shown, contained within display chamber 21 would be released to the next purchaser to insert proper coinage in the vendor after rollers 52 enter elevator platform. Finger 66 will now be in a position of engagement with hook 67. Hook 67 is pivotally secured to bracket 100 which in turn is rigidly affixed to support member 60. Operatively associated with hook 67 is linkage 68, lock cam 69 and lock shaft 70. In the case of an Empty storage area, as is now being described, the only function of said linkage, cam and shaft is to fix hook 67 in a predetermined position. As purchaser access door 12 is opened, finger 66 engages with hook 67 and, being interconnectedly associated with linkage 71, exerts force on display chamber catch 41 which is rigidly affixed to drive tube 72 and arm 73 which in turn are rotatably associated with shaft 74, said shaft being secured to the ends of display chamber 21. Catch 41 rotates away from pin 42 and outer shell 75 of door 12 opens about hinge 40 exposing the contents of display chamber 21.

Figure 10:
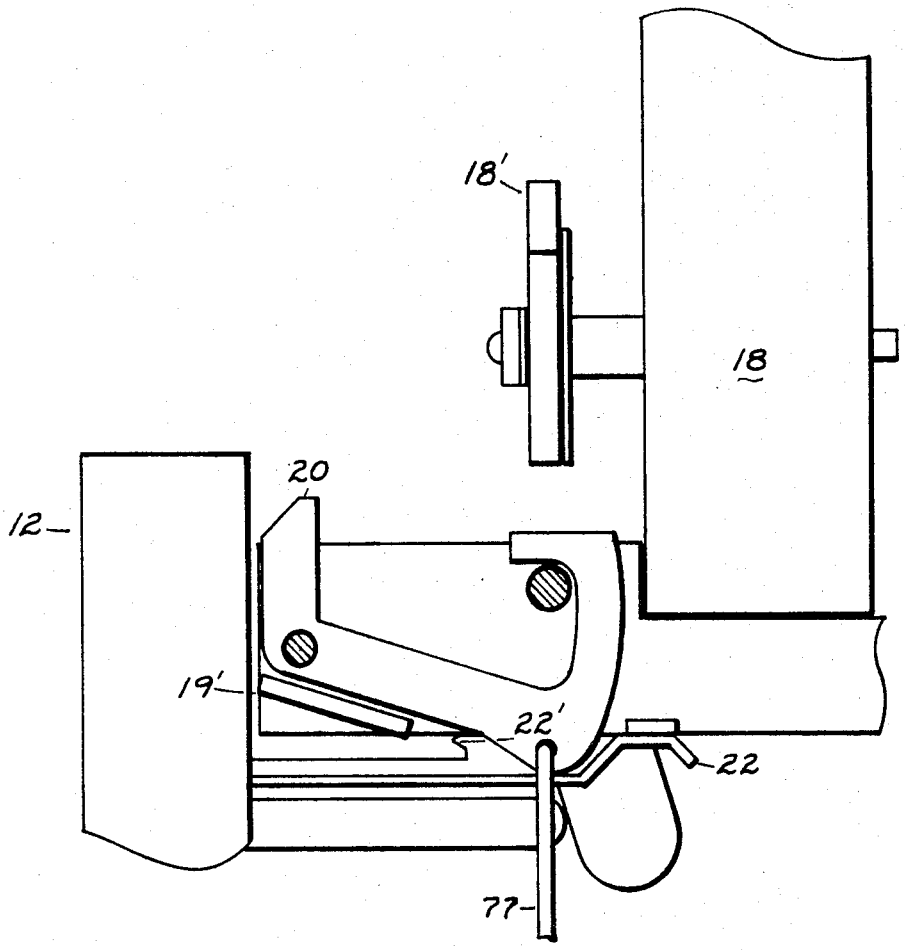
FIG. 10 is a side view of the coin mechanism showing the key release function.

Again in reference to FIGS. 2 and 6 and FIG. 10; operatively associated with lock shaft 70 is a Chicago Lock EXA-107 cylinder lock, lock cam 76 and control rod 77. At such time as a new edition of a newspaper is to be placed in the vendor, a new display copy DC must be inserted in display chamber 21. Upon activation of said cylinder lock in a clockwise manner, control rod 77 restrains finger 20 in such manner that hook 22', an integral part of latch 22, may be prevented from engaging catch 19', a functional part of frame 51, and access door 12 is free to open. This function is not unlike that performed by cam 18' as proper coinage is inserted in coin mechanism 18. Simultaneous with the lowering of rod 77, linkage 68, being pivotally associated with hook 67, is raised to bring hook 67 into a position of interference with finger 66. As outward force is applied to door 12, separation assembly 16 moves out on drawer guides 50 and finger 66 engages hook 67 releasing outer shell 75 from display chamber 21 thus exposing the interior thereof for replacement. Upon insertion of a new display copy DC, outer shell 75 is reclosed and lock is restored to its locked position.

Figure 8:
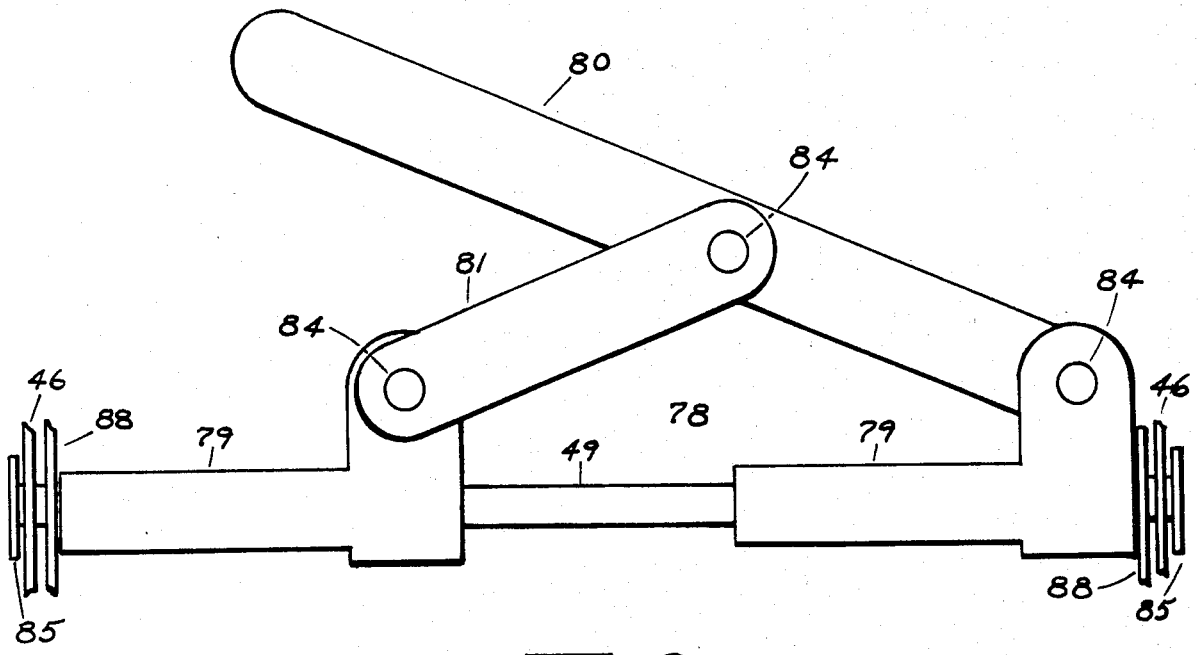
FIG. 8 shows the means for adjusting appropriate relationship between slide support assembly and slide side members.

In reference to FIGS. 7 and 8; locking device 78 is comprised of sliding clevises 79, handle 80, linkages 81, rod 49, pins 84, rod ends 85 and appropriate retaining devices for pins 84. As force downward is applied to handle 80 in cooperation with linkages 81, sliding clevices 79 are forced in opposite directions locking slide support assembly 88, side members 46 and rod ends 85 in a fixed position. Said rod ends being affixed to the ends of rod 49, thus provide the unitized separation assembly heretofore described. Handle 80 is so oriented that when product storage access door 11 is opened to reload machine, said handle may be grasped to release and lower guide assembly 24 into the position shown in FIG. 7.

Figure 13:
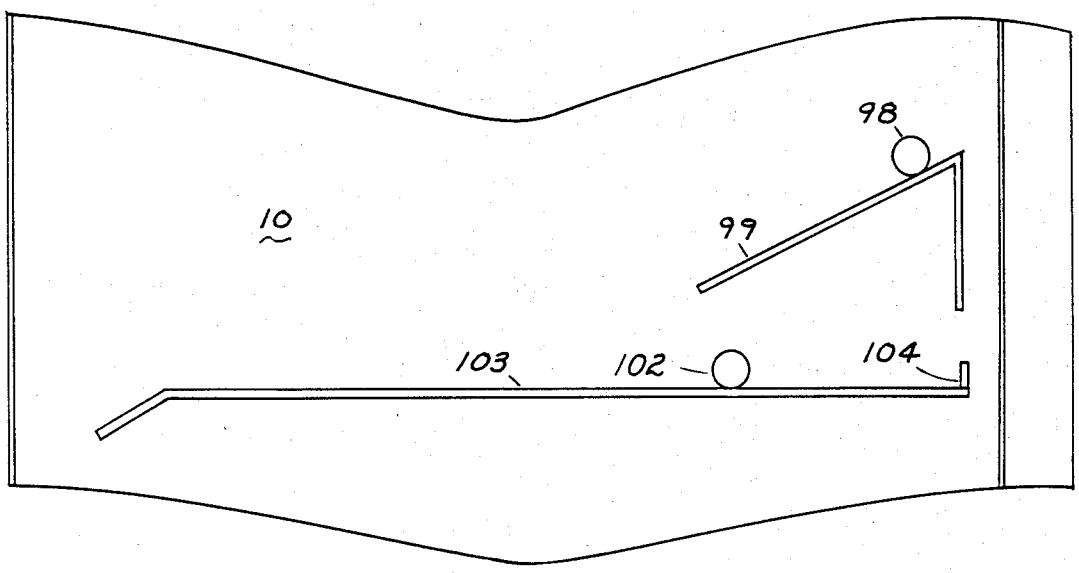
FIG. 13 is a partial view of the inside of a cabinet side wall.

In reference to FIG. 13; as said door is opened, support roller 102 and its counter-part, brake roller 63 traverse support rails 103 until stops 104 are engaged. Sufficient force applied to handle 80 in an upward motion will release locking device 78, freeing slide 45 and slide support assembly 88 to seek a new juxtaposition and free rollers 102 and 63 from stops 104. Outward motion of product storage access door 11 may now continue until card holder 30 reaches a position of support. Guide assembly 24 may now be lowered to the position shown in FIG. 7. Continuing downward motion will permit slide 45 to assume the position shown in FIG. 7. Sufficient downward force applied to handle 80 will then bring roller 89 in contact with display copy DC thus establishing a proper relationship between slide support assembly 88 and slide 45' as it relates to this particular edition. Additional downward pressure on handle 80 brings locking device 78 into its locked position, thus maintaining the above mentioned proper relationship between said slide 45 and slide support assembly 88. Guide assembly 24 with its accompanying separation assembly 16 may then be raised and subsequently replaced within the cabinet 10 by raising product storage access door 11. While neither shown nor required, a stop to prevent side members 46 from engaging sheaves 92 is desirable.

Figure 11:
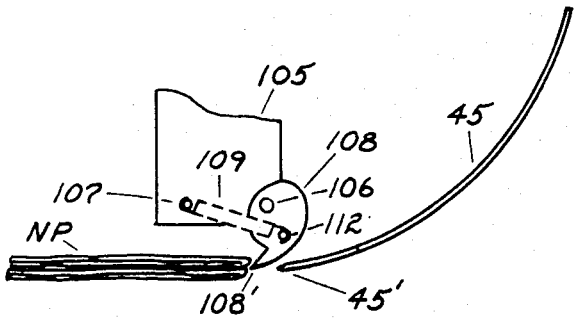
FIG. 11 shows a special hooked device for use with very thin newspapers.
Figure 12:
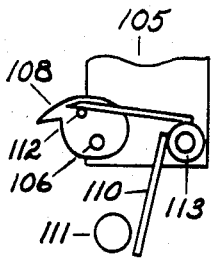
FIG. 12 shows the reset system for hooked device.

In reference to FIGS. 11 and 12; a lifting device may be provided to aid the insertion of point 45' between topmost and second-most newspaper. Mount 105, rigidly affixed to slide support 96, receives rotatable shaft 106 and spring hanger 107. As separation device 16, containing slide support assembly 88 and its attendant slide support 96 traverses out or to the left as shown in said Figures, points 108' of rotatable elements 108, biased by spring 109, acting on spring hanger 107 and pin 112, engage topmost newspaper NP. As motion continues, points 108' will rotate about shaft 106, to which it is affixed, effectively lifting the edge of newpaper NP thus facilitating the entrance of point 45' between topmost newspaper and second-most newspaper. As elements 108 continue to rotate center line of spring 109 will pass the centerline of shaft 106 thus transferring its bias from restraining to advancing causing points 108' to snap away from newspaper and the heretofore described process continues. As guide assembly 24 returns to its at rest position, reset lever 110 rotateably supported by shaft 113, in turn affixed to mount 105, engages stop 111 rigidly affixed to cabinet 10 and pin 112 causing rotatable elements 108 to return to the position shown in FIG. 11, much in the same manner as it left said position. Appropriate stops, not shown, are provided to limit the rotation of elements 108. Use of a lifting device of this nature is not limited to the present invention but could be advantageously employed with the many types of separation devices such as, but not limited to, those taught by the present inventor's U.S. patent application Ser. No. 6/218,475, which has been abandoned, and U.S. Pat. No. 4,319,695 Dutro.

A ratchet, not shown but familiar to one skilled in the art, may be provided to insure machine cannot be recycled without insertion of additional coinage.

Figure 6:
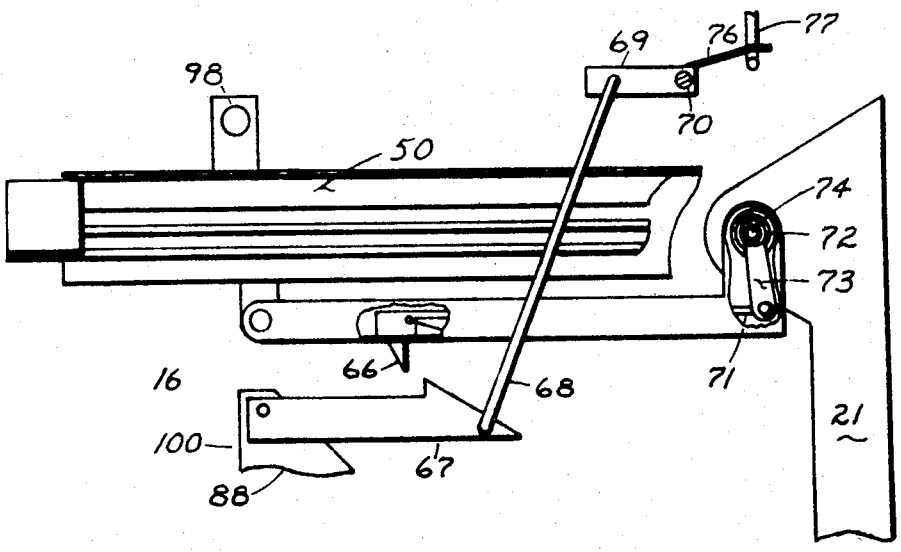
FIG. 6 is a view of the left hand side of the separation device.
Figure 14:
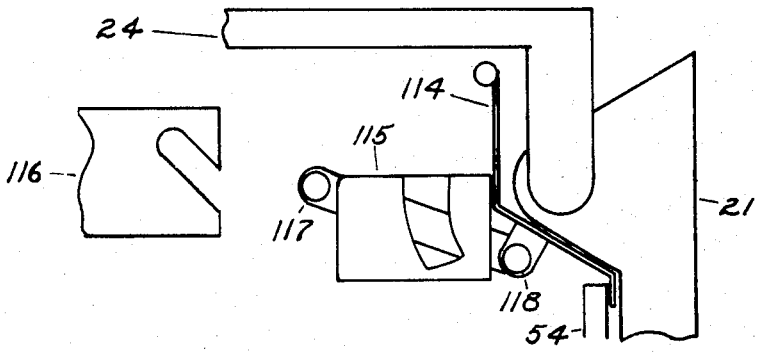
FIG. 14 shows a shield that may be provided to insure that only one newspaper may be removed.

In reference to FIGS. 6 and 14; the reorientation of finger 66, hook 67 and their respective linkages from beneath separation assembly 16 to the top thereof permits the addition of optional shield 114 which further secures product storage area against multiplicity of withdrawals with only a single coin insertion. Shield 114 is rotatably associated with product access door 11; support members 115 are rigidly associated with said door. Arms 117 are pivotally affixed to shield 114 by means of pins 118. Slotted members 116 are rigidly affixed to guide assembly 24.

As purchaser access door 12, represented in these Figures by display chamber 21 is opened, slotted members 116 engage the round projections of arms 117 lifting same above the obstructions presented by support members 115. When arms 117 have bottomed in slotted members 116, shield 114 will open permitting slide point 45' and a single newspaper to exit the enclosure. Upon return of guide assembly 24 and thus slotted member 116 toward their position of rest, arm 117 will be redeposited in the position shown thus reclosing and securing shield 114. It is to be understood that FIG. 14 is not intended to be in proper proportion but is offered as a graphic outline of an optional aspect of the invention.

Having described the present invention in detail, it is obvious that one skilled in the art will be able to make modifications and variations thereto without departing from the scope of the invention. Accordingly, the scope of the present invention should be determined by the claims appended hereto.

What is claimed is:

1. In a vending machine to dispense single copies of newspaper, magazine or the like comprising;

(a) a cabinet, said having a storage area associated therewith;

(b) a coin mechanism assembly mounted thereon, said mechanism having a coin receiving means therein and a release means to permit purchaser access to a chamber wherein is contained a single copy thereof;

(c) a hinged purchaser access door;

(d) a dispensing mechanism associated with said door in such manner that opening of said door will effect the separation of a single copy by inserting a portion of said dispensing mechanism generally between the topmost and secondmost copy thereinunder; said dispensing mechanism moving from the back generally toward the purchaser;

(e) an elevator so oriented as to continue presenting copies of the publicaiton to said dispensing mechanism;

an improvement comprising the dispensing mechanism including a cam roller, the cabinet including a ramp surface contacting the cam roller; the relationship between the cam roller and ramp surface being such that as the access door is opened and the cam roller moves along the ramp surface a portion of the dispensing mechanism first slides between the topmost and second most copies and then raises the top most copy upwardly above a vertical extending restraining surface whereby the top most copy is allowed to fall to a position of customer access as the access door is moved to an open position.

2. In the vending machine as defined in claim 1 wherein the dispensing mechanism includes a slide support assembly and a separation assembly that are relatively movable to define therebetween the thickness of a single copy; the separation assembly being that part of the mechanism that includes structure that is inserted between copies.

3. In the vending machine of claim 2 wherein the dispensing mechanism includes a guide assembly, the slide support assembly is pivotably mounted at one end to the guide assembly and supported at another location by a spring that is mounted to the guide assembly whereby the support by the spring lessens the weight which the slide assembly would bear on a copy thereunder.

4. In the vending machine of claim 2 wherein a lifting device is mounted on the slide support assembly, the lifting device including a rotatable element and an over-the-center spring mounted between the slide support assembly and the rotatable element; the lifting device mounted to engage the top most copy as the access door is opened and to release said top most copy onto the separation assembly as the door moves further toward the open position.

* * * * *